68-19 SA
10/15/85 OR 4,546,625

United States Patent [19]

Norrell

[11] Patent Number: 4,546,625

[45] Date of Patent: Oct. 15, 1985

[54] DRY CLEANING MACHINE

[76] Inventor: William L. Norrell, 105 Dove Rise, Peachtree City, Ga. 30269

[21] Appl. No.: 635,521

[22] Filed: Jul. 30, 1984

[51] Int. Cl.[4] ..... D06F 21/04; D06F 29/00; C14C 15/00

[52] U.S. Cl. ..... 68/18 F; 69/23

[58] Field of Search ..... 68/18 R, 18 F, 19.2, 68/20, 24, 140, 142; 15/305; 55/290; 210/143, 369; 69/23, 30; 209/235, 255, 295

[56] References Cited

U.S. PATENT DOCUMENTS

| | | | |
|---|---|---|---|
| 3,349,582 | 10/1967 | Quinn et al. | 69/30 |
| 3,381,507 | 5/1968 | Burgo et al. | 69/23 |
| 3,531,954 | 10/1970 | Krupsky | 68/19.2 X |
| 3,568,477 | 3/1971 | Dixon et al. | 15/305 X |
| 3,906,756 | 9/1975 | Bone | 15/305 X |

FOREIGN PATENT DOCUMENTS

| | | | |
|---|---|---|---|
| 16804 | 6/1898 | United Kingdom | 69/30 |

*Primary Examiner*—Philip R. Coe
*Attorney, Agent, or Firm*—Edgar W. Averill, Jr.

[57] ABSTRACT

An improved dry cleaning machine of the type utilizing powdered cleaning agents and having a rotating drum. Such machines have a shroud which completely surrounds the rotating drum and the shroud is connected to a collector and to the intake of an air blower. The draperies, furs, or the like are to be cleaned are rotated in the drum with the powdered cleaning agent for a predetermined amount of time after which the air blower is turned on and the cleaning agents are evacuated from the drum and deposited in the collector. The improved machine has a plurality of spring loaded plates over various groups of openings through the side of the drum.

9 Claims, 10 Drawing Figures

DRY CLEANING MACHINE

BACKGROUND OF THE DISCLOSURE

The field of the invention is dry cleaning machines and the invention relates more specifically to dry cleaning machines of the type which utilize a powdered or non-liquid type of cleaning agent.

Machines of this general type have been known for many years, for instance, U.S. Pat. No. 1,377,247 to Heineke discloses a process for cleaning furs using sawdust impregnated with gasoline and ammonia with which the furs to be cleaned were to be tumbled. The furs were then placed in a closed rotatable drum which drum had openings in the side for removal of the cleaning agent. Other such devices are shown in U.S. Pat. Nos. 2,350,025, 3,381,507, 3,504,510 and 3,938,357.

Such machines have been found deficient in various regards largely relating to the holding of the cleaning agents during the cleaning process or the complete removal thereof after cleaning is complete.

SUMMARY OF THE INVENTION

It is an object of the present invention to provide a dry cleaning machine of the type utilizing a powdered cleaning agent which has the ability to securely hold the cleaning agent during the cleaning step and yet permit easy complete removal thereof when cleaning is complete.

The present invention is for an improved dry cleaning machine of the type having a rotating drum for tumbling cleaning agents and articles to be cleaned which drum has a plurality of ribs axially disposed along its inner surface, said drum having a front end for the loading and unloading thereof. A shroud completely surrounds the rotating drum and has an air entry port located at the center of the front end of the rotating drum and an air exit port. The drum is provided with means for rotating the same in either a counterclockwise or clockwise direction. An air blower has its air intake connected to the air exit port of the shroud and a cleaning agent collector or filter is affixed to the exit port between the air exit port of the shroud and the intake of the air blower. The improved blower has a plurality of groups of openings through the side of the rotating drum between the ribs thereof. A plate is held by biasing means against the outer surface of the drum over each group of openings, each plate conforming to the shape of the outer surface of the drums so that all the openings of each group of openings are closed by the plate. The biasing means is of a strength sufficient to permit the plate to move away from the outer surface of the drum when the air blower means is activated and sufficient to hold the plate against the drum when the air blower means is turned off.

DESCRIPTION OF THE PREFERRED EMBODIMENTS

Figure 1:
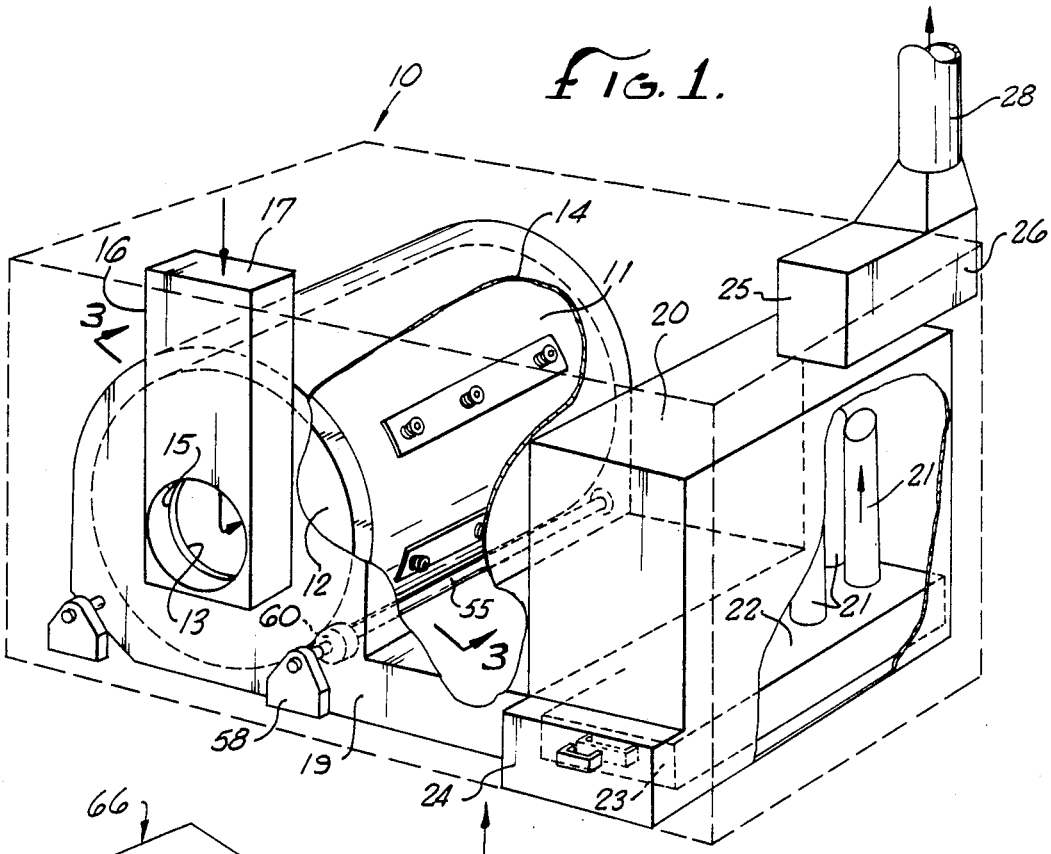
FIG. 1 is a perspective view, partially cut away, of the improved dry cleaning machine of the present invention showing the enclosure in phantom lines.
Figure 2:
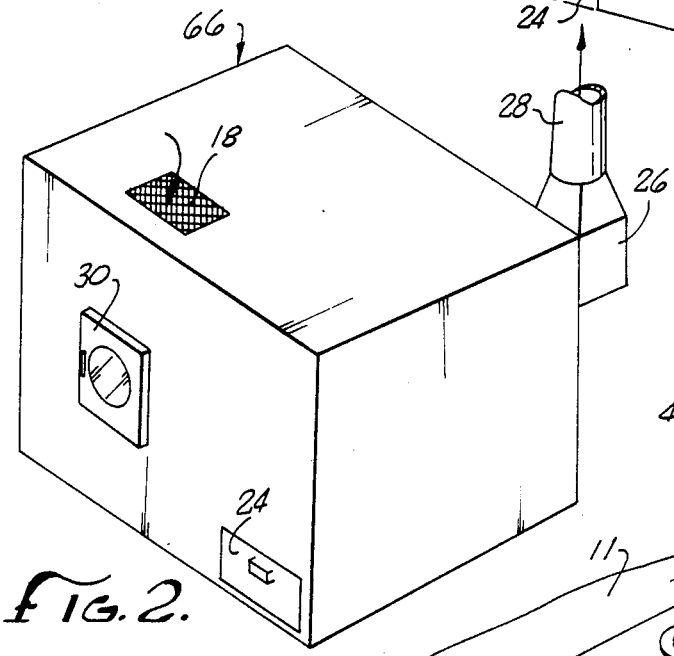
FIG. 2 is a perspective view of the exterior of the improved dry cleaning machine of the present invention.

The improved dry cleaning machine of the present invention is shown in perspective view and indicated by reference character 10 in FIG. 1. The machine has a drum 11 which may be rotated in either a clockwise or counterclockwise direction. The drum has a first end 12 which has an opening 13 for loading and unloading of materials to be cleaned as well as the cleaning agents. The drum is completely surrounded by a shroud 14 which has an entrance 15 near the front end of the drum and which is connected to an air entry duct 16. The entry opening 17 of air duct 16 is preferably covered with an air filter which is shown in FIG. 2 and indicated by reference character 18.

The air exit portion of the shroud is located generally at 19 and air passes from the exterior of drum 11 into the collector 20 which has a plurality of collector tubes 21 which fit over collars (not shown) held on plate 22. Means not shown are available for shaking plate 22 to cause the dust and powder within tubes 21 to fall into a drawer 23 shown in phantom lines in FIG. 1. A door 24 is held in an airtight manner below collector 20 to permit the removal of drawer 23 for emptying once a day or at any other convenient time interval. An air plenum 25 is connected to a blower located within housing 26 which has an exit pipe 28.

Figure 3:
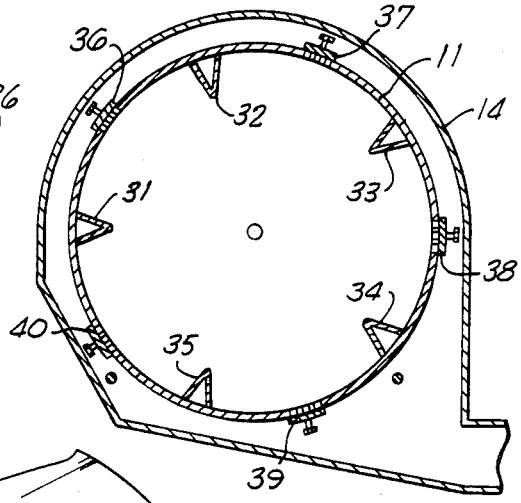
FIG. 3 is a cross-sectional view taken along line 3—3 of FIG. 1.
Figure 4:
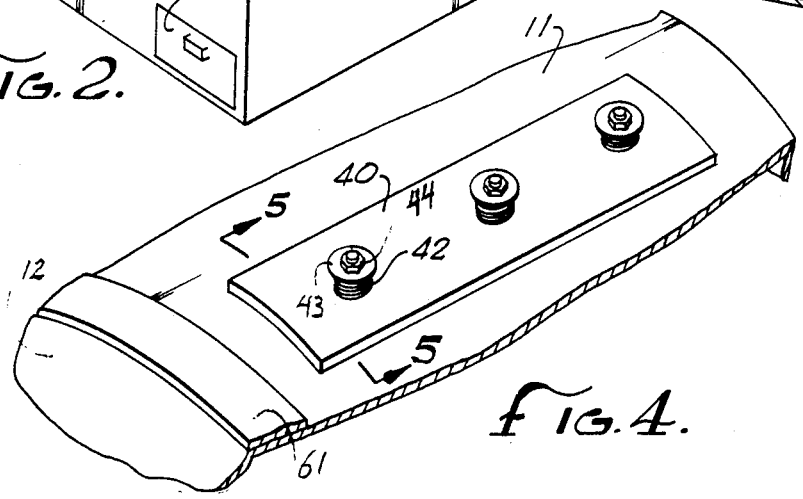
FIG. 4 is a fragmentary enlarged perspective view of one of the plates on the exterior of the drum of the dry cleaning machine of FIG. 1.
Figure 7:
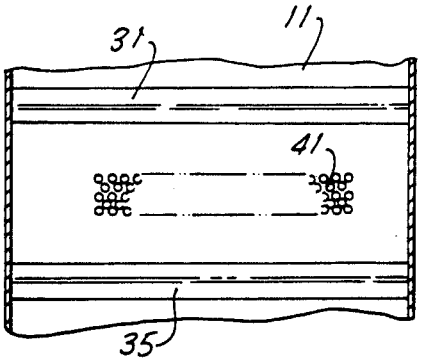
FIG. 7 is a perspective view of the rear of the dry cleaning machine of FIG. 1 showing the drum in phantom view.

In operation, draperies, furs or other materials to be cleaned are loaded into the interior of the drum through openings 15 and 13. Powdered or granular cleaning agents such as diatomaceous earth containing a cleaning solvent, brightener, odorant and the like is placed with the materials to be cleaned. An outer door (shown in FIG. 2 and indicated by reference character 3) is closed and the drum is rotated therein. A plurality of ribs are welded to the interior surface of the drum to cause the materials to be cleaned to tumble and be thoroughly mixed with the cleaning agents. These ribs are shown in FIG. 3 and indicated by reference characters 31 through 35. Preferably this cleaning step is preceded by a predust step to remove heavy dust and lint. A ten minute predust step with a drum rotating at 28 revolutions per minute and reversing every 30 seconds has proved highly effective for predusting. After the chemicals have been added, the materials to be cleaned and the chemicals are tumbled for about 20 minutes to thoroughly contact the cleaning agents with the materials to be cleaned. During this cleaning step it is important that the cleaning materials be held securely within the drum. This is accomplished by a plurality of plates indicated in FIG. 3 by reference characters 36 through 40. These plates are configured to fit tightly against the exterior of the drum and they completely cover five groups of openings such as those shown in FIG. 7 and indicated by reference character 41. Holes of 5/16 inch diameter provide an appropriate opening size and 15 rows of 36 holes on one inch centers provides an ideal configuration for most materials to be cleaned.

Figure 5:
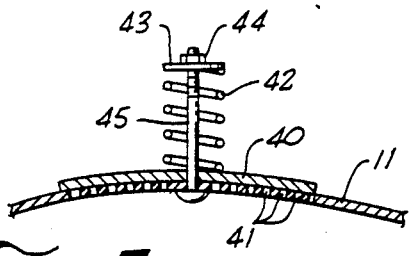
FIG. 5 is a cross-sectional side view of the plate of FIG. 4 in a closed configuration.

The plates such as plate 40 are held against the drum 11 by three springs such as spring 42 shown in FIG. 5. A washer 43 is held by a nut 44 on carriage bolt 45 to hold spring 42 against the outer surface of plate 40. As can be clearly seen in FIG. 5, plate 40 completely closes all the openings 41 in drum 11.

Figure 6:
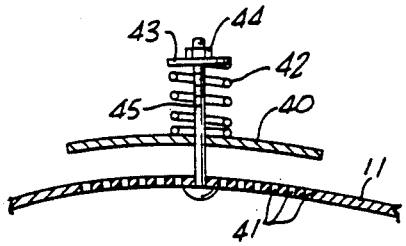
FIG. 6 is an enlarged cross-sectional view of the plate of FIG. 4 in open configuration.

After the cleaning stage has been completed, the blower is turned on and air is drawn through air entry filter 18, duct 12 and into drum opening 13. The reduced air pressure within shroud 14 causes air to flow through openings such as openings 41 and the strength of springs such as spring 42 is selected such that the plates such as plate 40 rise away from the openings as shown in FIG. 6. This allows the cleaning agents to pass through the openings and into the collector 20. During this extracting step the drum is also oscillated by reversing rotation direction every 30 seconds. This extraction step is generally complete after 20 minutes following a 20 minute cleaning step. An air blower utilizing a squirrel cage fan and driven by a five horsepower motor at 3600 revolutions per minute is capable of moving 3200 cubic feet per minute. This is adequate for a drum size of a length of 48 inches and a diameter of 54 inches.

Figure 8:
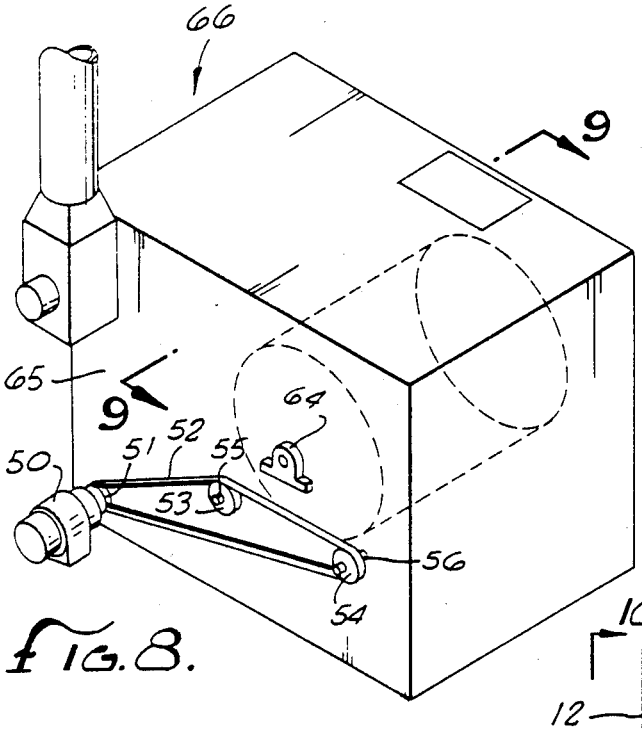
FIG. 8 is a side view of the drum and its associated drive means of the dry cleaning machine of FIG. 1.
Figure 10:
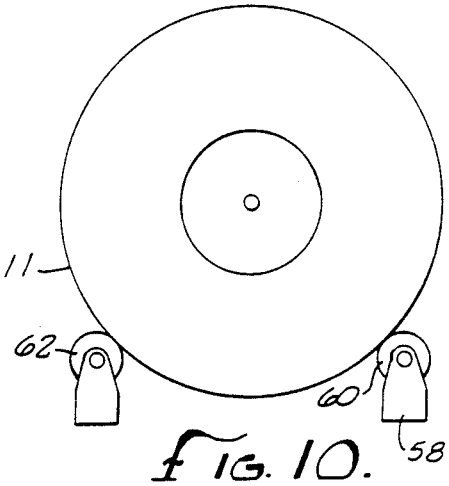
FIG. 10 is a side view taken along line 10—10 of FIG. 9.
Figure 9:
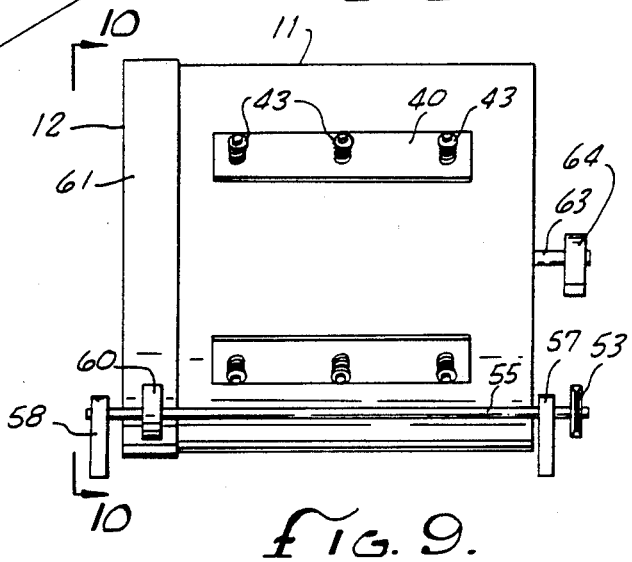
FIG. 9 is a view taken along line 9—9 of FIG. 8.

The drive system used for rotating drum 11 is shown best in FIGS. 8 through 10. A drive motor 50 has a pulley 51 which drives a drive belt 52 which, in turn, drives pulleys 53 and 54 connected to shafts 55 and 56 respectively. Shaft 55 is supported by bearings 57 and 58 shown in FIG. 9 and a urethane drive wheel 60 supports the front end 12 of drum 11. A track 61 is welded to the exterior of drum 11 to provide a smooth riding surface for the drive wheels. Similarly drive wheel 62 (shown in FIG. 10) rides on track 61 and also supports the front end 12 of drum 11. The rear of drum 11 is supported by a shaft 63 which is held in a bearing 64 supported by the rear 65 of housing 66. When motor 50 reverses direction, of course, the drum rotation is also reversed which assists the cleaning operation.

It has been found that by locating the openings 41 at the midpoint between adjacent ribs that a particularly effective cleaning agent removal results. By utilizing five ribs and five sets of openings it is believed that an optimum combination of material agitation without undue wear on the materials results. Whereas helical springs are shown in the drawings, other biasing means could, of course be used as long as an appropriate amount of biasing force is exerted so that the plates are held against the drum until the air blower is turned on.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

WHAT IS CLAIMED IS:

1. In a machine of the type for cleaning draperies, furs and the like having:

a rotating drum for tumbling cleaning agents and articles to be cleaned, said drum having a plurality of ribs axially disposed along its inner surface, said drum having a front end for the loading and unloading thereof;

a shroud completely surrounding said rotating drum, said shroud having an air entry port located at the center of the front end of the rotating drum and an air exit port;

means for rotating said drum;

air blower means having an air intake connected to the air exit port of said shroud;

collector means affixed to the air exit port of said shroud, said collector means being located between said air exit port and the intake of the air blower means; wherein the improvement comprises:

a plurality of groups of openings through the side of said drum between the ribs thereof;

a plate held by biasing means against the outer surface of the drum over each group of openings, said plate conforming to the shape of the outer surface of the drum so that all openings of each group of openings are closed by said plate, said biasing means being of a strength to permit the plate to move away from the outer surface of the drum when said air blower means is activated and sufficient to hold the plate against the drum when said air blower means is turned off.

2. The improved dry cleaning machine of claim 1 wherein each of said plates is held to the outer surface of the drum by a plurality of helical springs.

3. The improved dry cleaning machine of claim 2 wherein said helical springs are held against the outer surface of each of said plates by bolt means affixed to said drum and passing through said plate.

4. The improved dry cleaning machine of claim 3 wherein said bolt means are positioned along the longitudinal central bisecting axis of each of said plates.

5. The improved dry cleaning machine of claim 4 wherein each of said plates has three bolt means, each of said bolt means being surrounded by a helical spring.

6. The improved dry cleaning machine of claim 1 wherein there are five ribs on the inner surface of the drum and five sets of openings through the side of the drum, each of said sets being positioned between two rib means.

7. The improved dry cleaning machine of claim 6 wherein each of said sets of openings are positioned in the mid-point between adjacent rib means.

8. The improved dry cleaning machine of claim 1 wherein said drum is rotated by a pair of driven wheels positioned at the front edge of the drum, said wheels supporting the front of the drum and an axially positioned bearing at the back of the drum supporting the back of the drum.

9. The improved dry cleaning machine of claim 8 wherein said wheels are supported on two shafts which are driven and supported from outside of the shroud.

* * * * *